US006071069A

United States Patent [19]

Wyssmüller et al.

[11] Patent Number: 6,071,069

[45] Date of Patent: Jun. 6, 2000

[54] METHOD FOR UNLOADING REAMS OF SHEETS AND APPARATUS FOR UNLOADING REAMS OF SHEETS

[75] Inventors: Philippe Wyssmüller, Jouxtens-Mezery; Daniel Baertschi, Romanel, both of Switzerland

[73] Assignee: De La Rue Giori S. A., Lausanne, Switzerland

[21] Appl. No.: 09/037,246

[22] Filed: Mar. 9, 1998

[30] Foreign Application Priority Data

Mar. 26, 1997 [CH] Switzerland ..... 0735/97

[51] Int. Cl.[7] ..... B65G 67/00

[52] U.S. Cl. ..... 414/807; 414/331.07; 414/331.08; 414/396; 414/400

[58] Field of Search ..... 414/222.04, 222.05, 414/222.09, 222.1, 226.04, 292, 331.07, 331.08, 340, 341, 343, 345, 347, 396, 400, 498, 539, 807

[56] References Cited

U.S. PATENT DOCUMENTS

| | | | |
|---|---|---|---|
| 1,883,493 | 10/1932 | Berg | 414/390 |
| 3,637,095 | 1/1972 | Kampfer | 414/331.08 X |
| 4,183,708 | 1/1980 | Kuhbier et al. | 414/498 X |
| 4,239,447 | 12/1980 | Bach | 414/813 |
| 4,621,969 | 11/1986 | Berghall et al. | 414/331.08 X |
| 4,634,333 | 1/1987 | Butterly, Jr. et al. | 414/331.07 |
| 5,024,576 | 6/1991 | Meschi | 414/400 X |
| 5,172,968 | 12/1992 | Robinson | 312/297 |
| 5,224,812 | 7/1993 | Oslin et al. | 414/498 X |
| 5,337,880 | 8/1994 | Claycomb et al. | 414/331.08 X |
| 5,441,376 | 8/1995 | Napierkowski et al. | 414/396 X |

FOREIGN PATENT DOCUMENTS

| | | |
|---|---|---|
| 718810 A2 | 6/1996 | European Pat. Off. . |
| 725027 A2 | 8/1996 | European Pat. Off. . |

*Primary Examiner*—James W. Keenan

*Attorney, Agent, or Firm*—Pitney, Hardin, Kipp & Szuch, LLP

[57] ABSTRACT

The method for unloading the reams from a machine for the production of securities comprises the following steps:

a) placing of a container (1) having at least one door (6) on the same side as the tray rack (31) of the machine (34), b) positioning and locking of the container relative to the rack, c) transfer of the trays (32) carrying the reams (36) from the rack into the container, d) closing of the door of the container, e) unlocking of the container, the latter then being capable of being moved.

4 Claims, 11 Drawing Sheets

METHOD FOR UNLOADING REAMS OF SHEETS AND APPARATUS FOR UNLOADING REAMS OF SHEETS

FIELD OF THE INVENTION

The invention relates to a method for unloading one or more reams of sheets, in particular of sheets of securities, from an exit of a machine belonging to an installation for the production of securities, and to an apparatus for unloading one or more reams of sheets.

The term "machine for the production of securities" is intended, in particular, to comprise printing machines, numbering machines and machines for the quality control of securities.

PRIOR ART

In known production machines, in particular for intaglio printing, the paper sheets intended to be printed are delivered to the entrance of the printing machine, pass through the latter one after the other and receive either only recto or recto/verso prints. The sheets are finally sent to the exit of the printing machine.

The exits of machines for producing securities generally comprise at least two racks, and these are filled in the following way: a board in the form of a tray or pallet is introduced into one of the racks on horizontal slideways which are mounted on a system of the paternoster type. The tray subsequently receives the printed sheets, until a ream of specific size, for example of five hundred sheets, is formed. At this moment, the other rack, into which a tray will have been introduced beforehand, is selected for the new printed sheets arriving at the exit, whilst the slideways and the tray carrying the ream of sheets of the first rack are shifted downward. A new tray is introduced on the slideways of the first rack, and printed sheets will be stacked on this tray as soon as this rack has been selected, that is to say when the tray of the second rack supports a complete ream. The stacking of the sheets on this new tray and on the following trays continues in this way alternately until the rack contains a specific number of trays, for example ten trays, each carrying a ream of five hundred sheets. Patent application EP 0 725 027 describes an example of filling the racks of a printing machine. In this application, the reams are finally transferred from the racks onto a carriage and taken away.

The emptying of an exit rack is an operation which is still carried out manually at the present time and during which the trays supporting the reams of sheets are removed from the rack and transferred onto a carriage. This transfer is carried out for all the trays of a rack, each rack generally containing ten trays, and, once the carriage is filled with the ten trays of the rack, it is taken away either towards another production machine or towards a storage location.

The major disadvantage of the manual transfer of the trays carrying the reams is that printed sheets may, on the one hand, be soiled or torn and, on the other hand, be stolen during the movement of the reams between two machines. Since each ream of sheets weighs between 30 and 40 kilos, manual unloading is a particularly laborious job. Moreover, thefts of printed sheets are not acceptable either.

SUMMARY OF THE INVENTION

The object of the invention is to reduce as far as possible the manual handling of the reams of printed sheets and consequently to reduce the risks that printed sheets will be damaged or will disappear. This object is achieved, according to the invention, by means of a method for unloading the reams of sheets from an exit of a machine having at least two tray racks, the method being defined by the following steps:

a) placing of a container comprising at least one door on the same side as the tray rack,
b) positioning and locking of the container relative to the rack,
c) transfer of the trays carrying the reams from the tray rack into the container,
d) closing of the door of the container,
e) unlocking of the container, the latter being capable of being moved.

This results in at least a partial automation of the method for unloading and transferring reams of sheets.

Preferably, all the reams of sheets are transferred simultaneously from the tray rack of the production machine into the container.

All the operations take place automatically by virtue of suitable control, transmission means and checking means. Thus, the delicate operation of transferring the trays carrying the reams from the rack into the container takes place in an always closed space, without manual handling, and, on the other hand, the container is released only at the moment when its door has been closed. The reams of printed sheets can therefore be moved without the risk of theft or damage.

The apparatus according to the invention for unloading reams of sheets of securities from the exit of a production machine having at least one tray rack comprises:

a closed container, at least one of the walls of which comprises a door capable of being opened and closed automatically,
means for positioning and locking the container relative to the exit rack,
means for opening and closing the door,
a transfer system for moving the trays carrying the reams from the exit rack into the container,
an automatic system for controlling and checking the positioning and locking means, the means for opening and closing the door, the transfer system and the position of the door.

One of the advantages of the apparatus according to the invention is that it is completely modular, so that it can be mounted both on new machines for the production of securities and on machines already in service.

BRIEF DESCRIPTION OF THE DRAWINGS

The present invention will be understood better from the description of an embodiment and from the accompanying drawings.

The principle of the automatic unloading method is now described with reference to FIGS. 1 to 4.

DESCRIPTION OF THE PREFERRED EMBODIMENT

Figure 1:
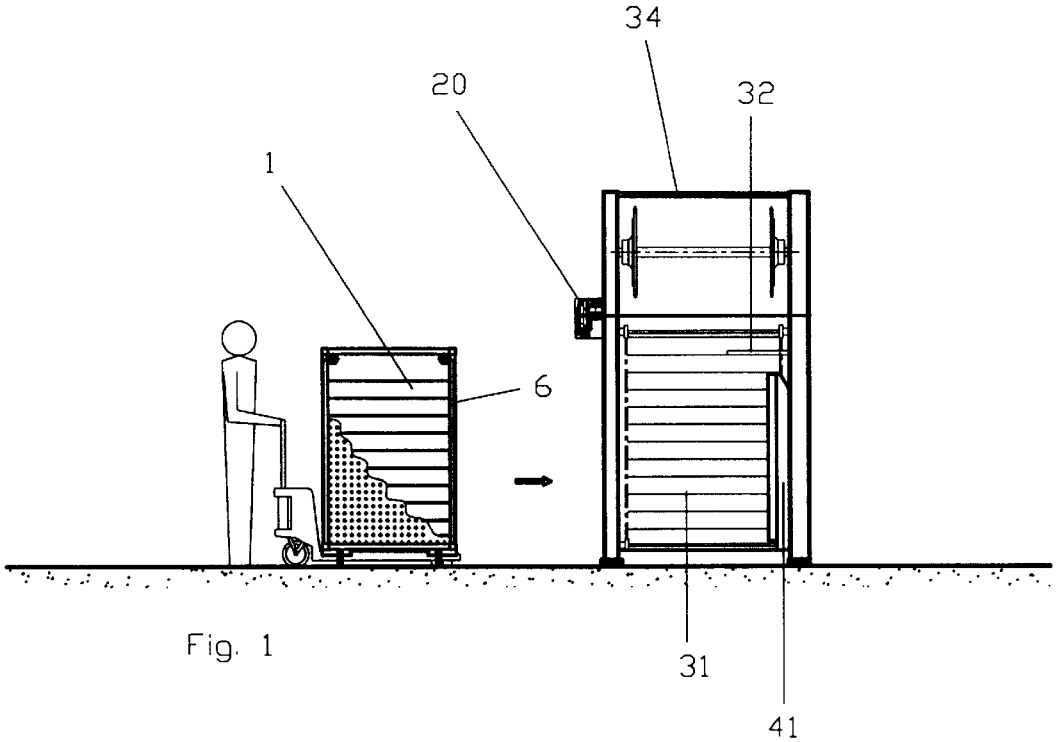
FIGS. 1 to 4 show the principle of the automatic unloading method.

In FIG. 1, a tray rack 31 of a machine 34 for the production of securities is equipped with an indexing and interlocking system 20 and with a pusher 41, said system and said pusher being described in more detail later. A first tray 32 is introduced into the rack 31. A closed container 1 comprising a door 6 is brought in front of the exit of the tray rack 31. The indexing and interlocking system 20 is retracted. Moreover, the pusher 41 is retracted to the back of the tray rack 31.

Figure 2:
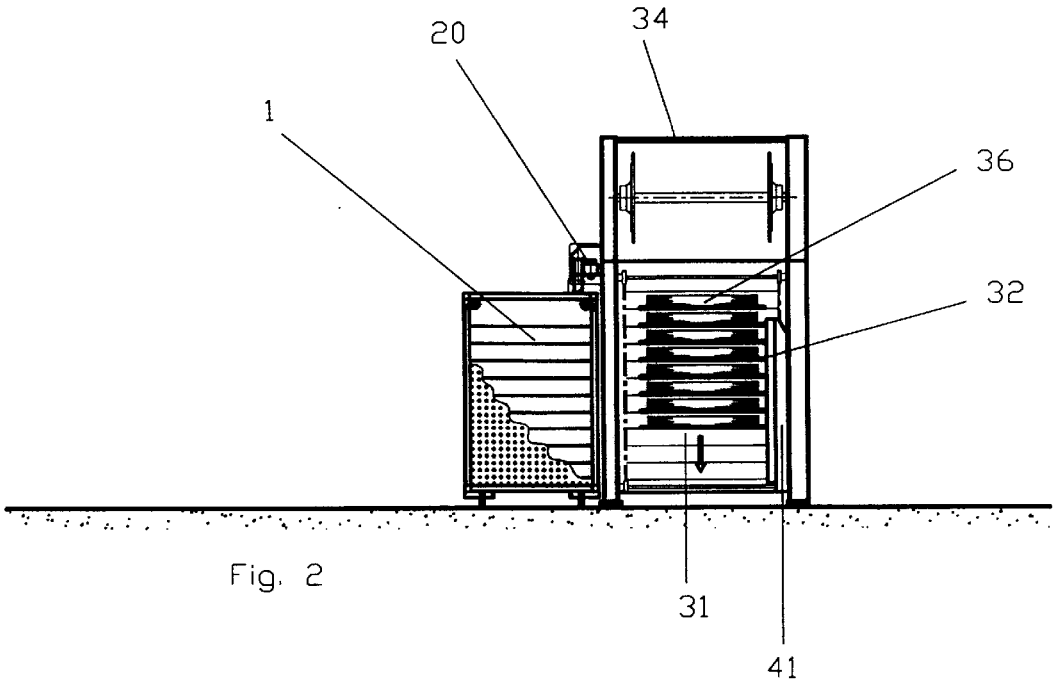

In FIG. 2, the machine 34 is in production: the printed sheets arrive at the top of the tray rack 31, said sheets being driven by a gripper chain system and being released in the rack. The tray rack 31 is filled with reams of sheets 36 on the trays 32, the trays as a whole being shifted downward when a new tray is introduced on the slideways from the top of the rack 31. The container 1 is positioned relative to the tray rack 31 of the production machine 34 and the pusher 41 is still in the retracted position.

Figure 3:
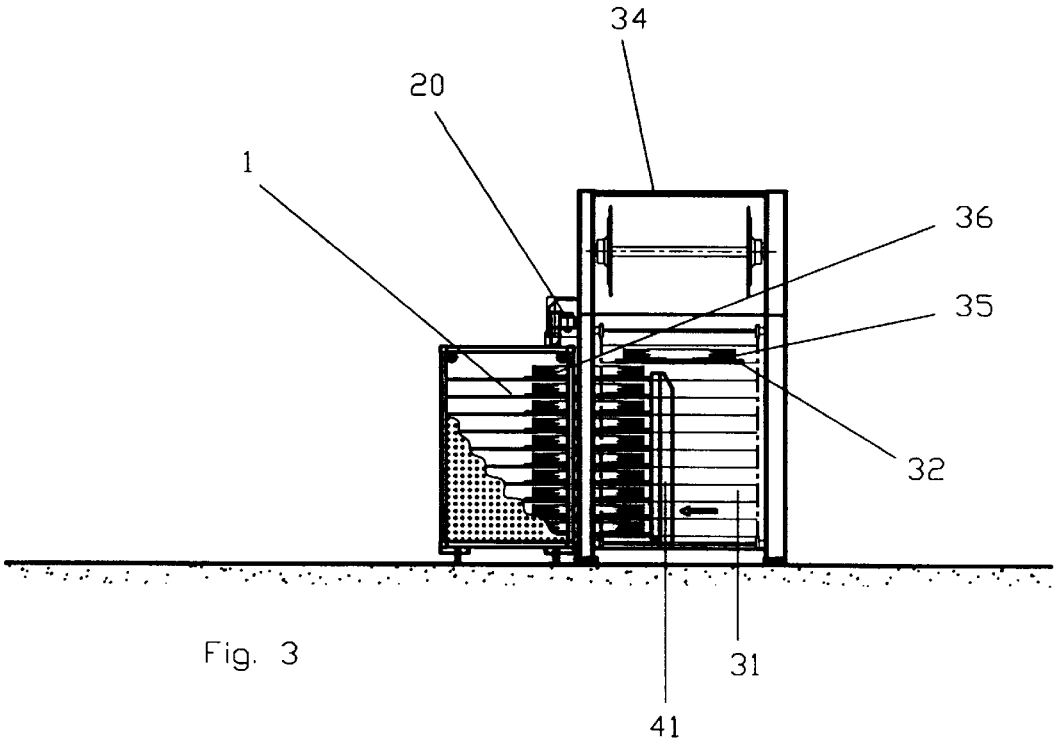

In FIG. 3, the container 1 is set by indexing and is interlocked with the tray rack 31 of the production machine 34, the door 6 of the container 1 has been opened and the pusher 41 is in the process of transferring a set of ten trays 32, each carrying a ream of sheets 35, into the container 1 via the open side of the exit rack 31, whilst an eleventh tray 32, located at the very top in the exit rack 31, receives printed sheets which will form a new ream 35. Once the transfer has ended, the door of the container 1 is closed, the indexing and interlocking system 20 is removed and the pusher 41 returns to the back of the exit 31.

Figure 4:
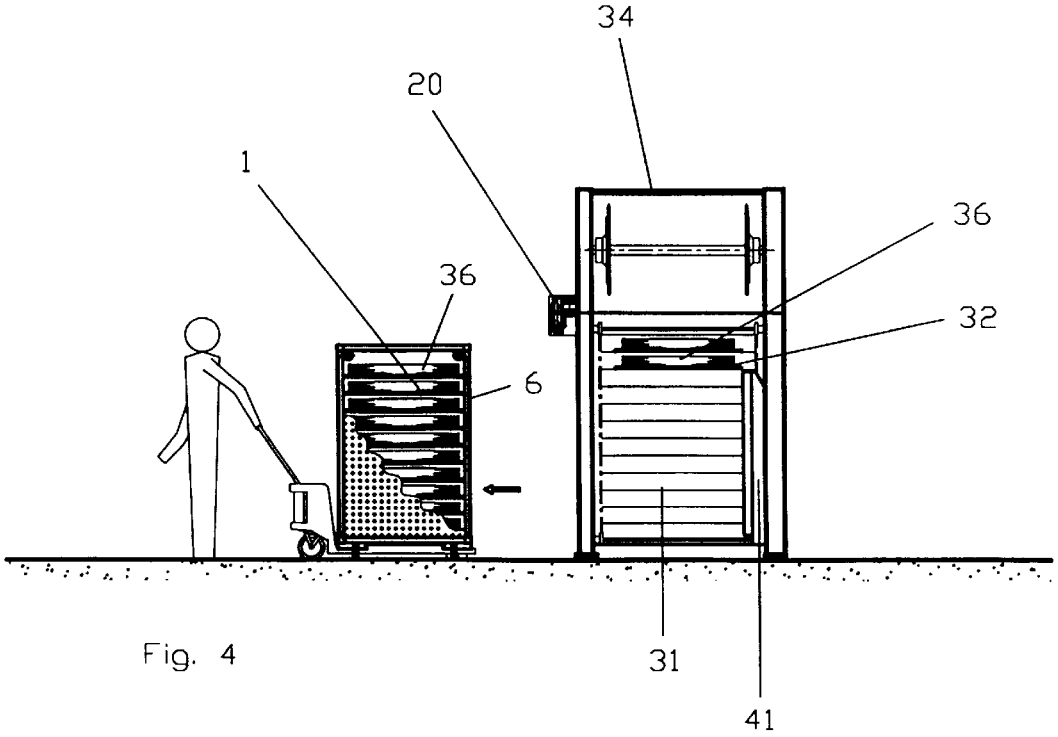

In FIG. 4, the closed container 1 filled with reams of sheets 36 is taken away on a pallet truck, whilst the tray rack 31 of the machine 34 is being filled with trays 32 and reams of sheets 36 once again.

Figure 5:
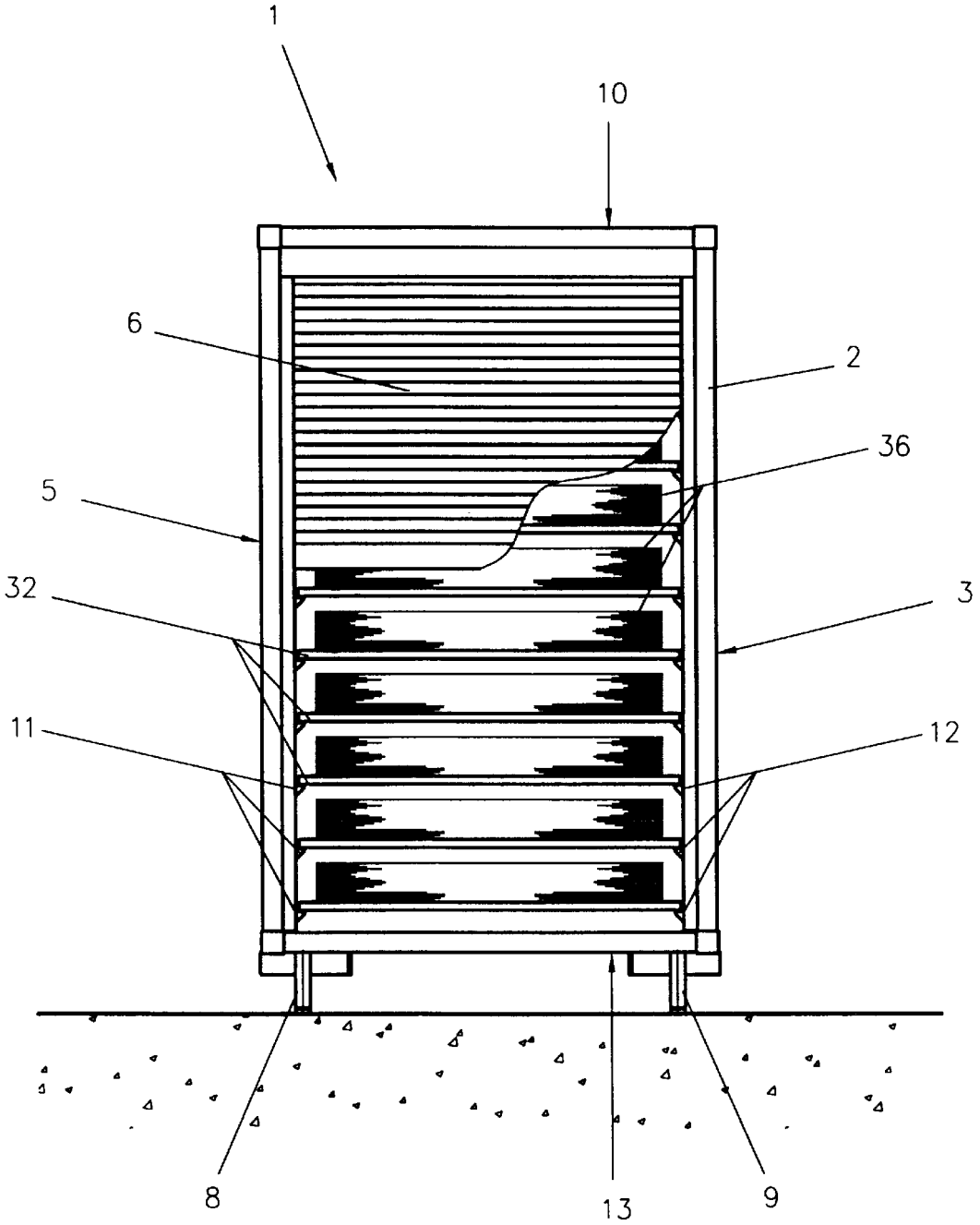
FIG. 5 is a front view of a container.
Figure 6:
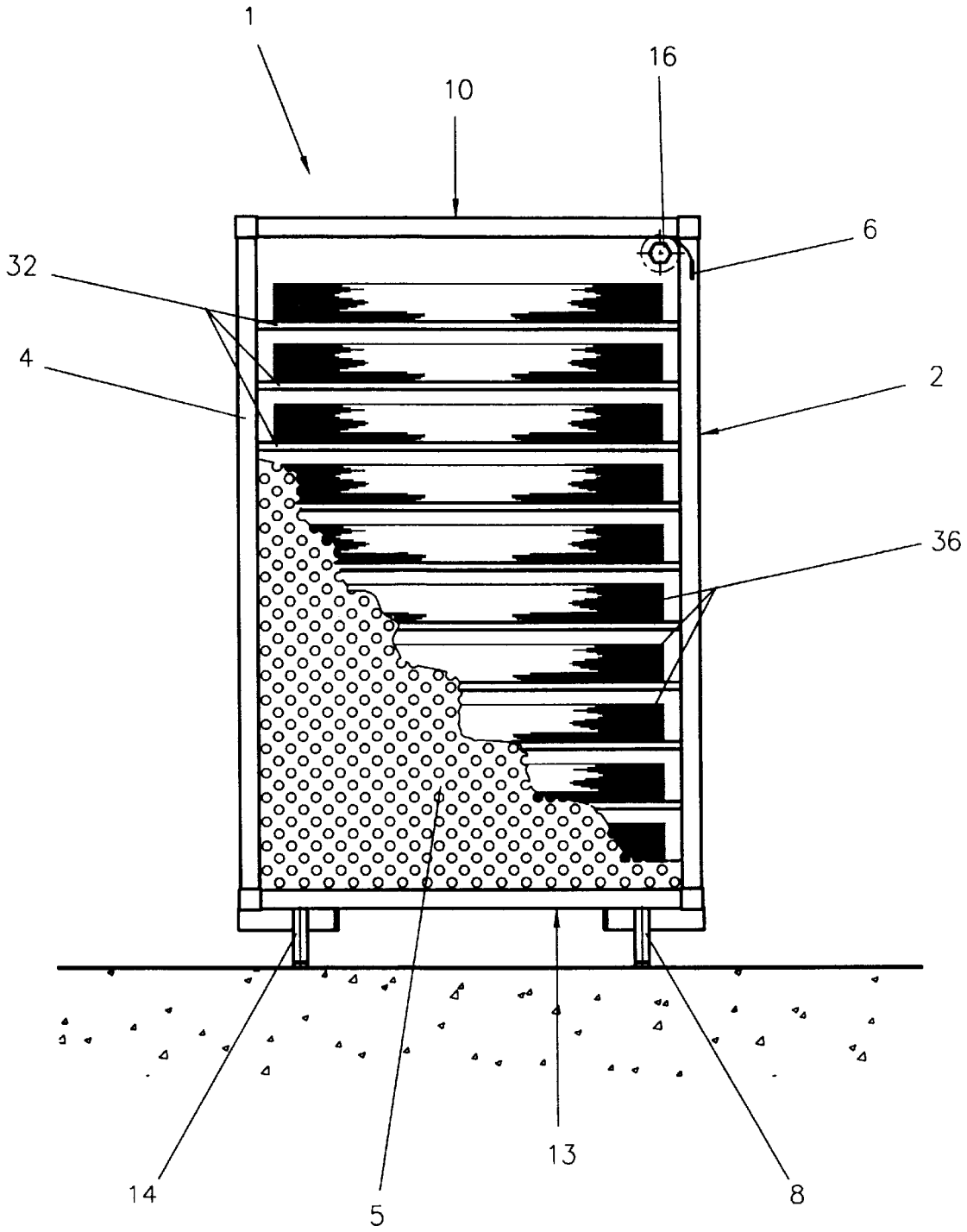
FIG. 6 is a partial sectional side view of a container.
Figure 7:
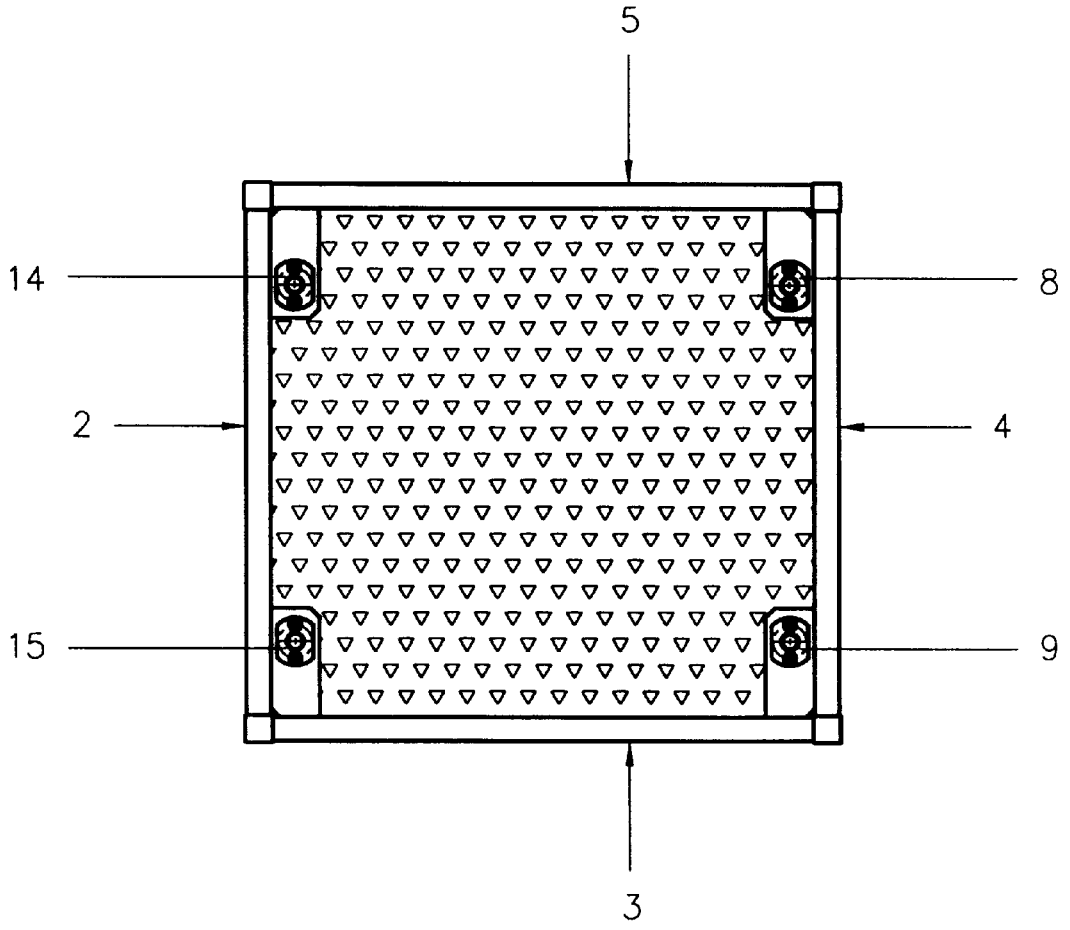
FIG. 7 is a bottom view of a container.

The container 1 is described with reference to FIGS. 5 to 7. It is completely closed and comprises a frame supporting four side walls 2, 3, 4 and 5, one of which comprises a vertically sliding door 6. The container comprises, furthermore, horizontal slideways 11, 12 facing one another in pairs in order to receive the trays 32 carrying the reams 36 of sheets. The vertical spacing between the slideways 11 and between the slideways 12 corresponds to the vertical spacing between the supports of the trays 32 in the rack 31 of the production machine 34.

The container 1 also comprises four feet 8, 9, 14 and 15, a bottom 13 and a ceiling 10 which are fastened to the frame. The door 6 is wound on a support 16. FIGS. 5 and 6 also illustrate reams 36 on trays 32. Moreover, the fixed walls of the rack may be perforated.

The frame of the container is sufficiently rigid and sturdy to support a stack of a plurality of containers filled with reams of sheets. In addition, the ceiling 10 comprises means (not shown) for receiving the feet of the containers when these are being stacked.

Figure 8:
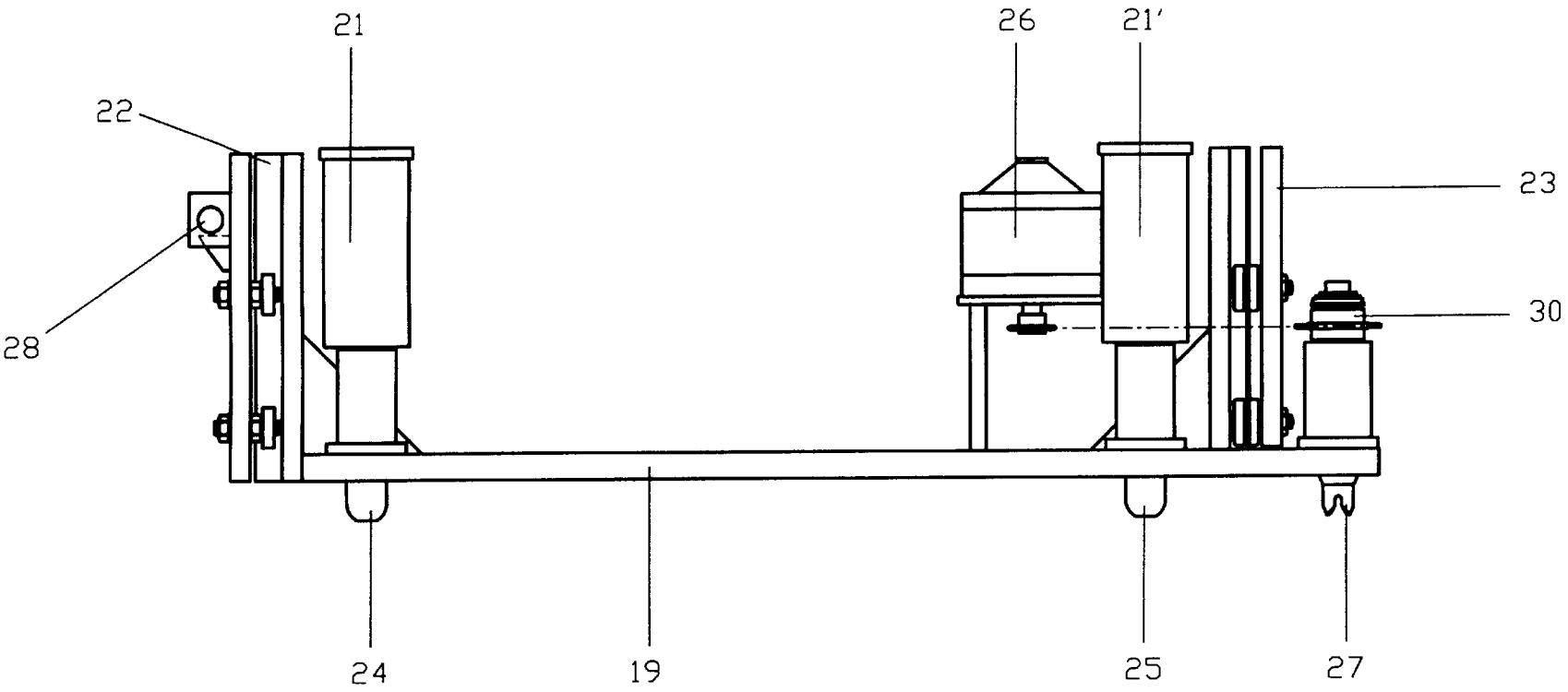
FIG. 8 is a front view of the indexing system.

The indexing and locking means 20 are described with reference to FIGS. 8 to 10. These means 20, which are fastened to the top of the tray rack 31 of the machine 34 for the production of securities, comprise a support 19, on which two positioning indexes 24, 25 are mounted. The support 19 is itself fastened to the tray rack of the production machine 34 by means of vertical guides 22, 23, for example slideway systems, making it possible to move said support in the vertical direction, this movement being actuated by means of two pneumatic jacks 21, 21'.

Advantageously, the two indexes 24, 25 may, furthermore, be mounted on springs (not shown), thus making it possible to compensate the position of the container 1 if the floor is not flat.

Means for opening and closing the door of the container are also fastened to the support 19. These means comprise at least one pneumatic motor 26, an opening and closing driver 27, a means for transmission between the motor 26 and the driver 27, and a torque limiter 30.

The indexing and interlocking of the container 1 relative to a tray rack 31 of a production machine 34 are carried out in the following way: the container 1 is brought opposite the opening of the tray rack 31, either at the front or at the side, and the two feet 8, 9 of the container which are located on the same side as the machine 34 are introduced into two corresponding cones (not shown) in the floor which are fixed relative to the exit rack 31. By self-centering of the feet 8, 9 of the container 1 in the cones, the position of said container relative to the tray rack 31 is thus referenced.

The support 19 of the indexing system 20 is subsequently lowered along the guides 22, 23 by means of the pneumatic jacks 21, 21' and the positioning indexes 24, 25 penetrate into corresponding holes (not shown) of the container 1. Once these indexes 24, 25 are in place, the position of the container 1 is locked relative to the tray rack 31 of the production machine 34 and the transfer of the trays 31 can take place.

The door opening and closing driver 27 must again be actuated by means of a pneumatic door opening and closing motor 26, in order to open the door 6 of the container 1, for example by means of a belt.

The container 1 also comprises means making it possible to open its door 6 from outside. Since the container 1 illustrated in FIGS. 1 to 7 has a door 6 which is wound up in its upper part, these means may, for example, be a vertical endless screw, the upper end of which cooperates with the opening and closing driver 27 and the threaded lower end of which drives a horizontal support 16 in the container 1, the door 6 being wound around said support. If there is a problem during the winding of the door, a torque limiter 30 makes it possible to prevent the motor 26 from being overloaded. Once the door 6 is completely open, the transfer of the trays 32 can take place, and, as soon as this has ended, the control of the motor 26 is reversed and the door 6 is closed by means of the opening and closing driver 27.

In a particular variant, a safety finger 28 is added, this finger keeping the indexing and locking means in the raised position in the event that the supply of compressed air to the indexing and locking means 20 is interrupted.

Figure 9:
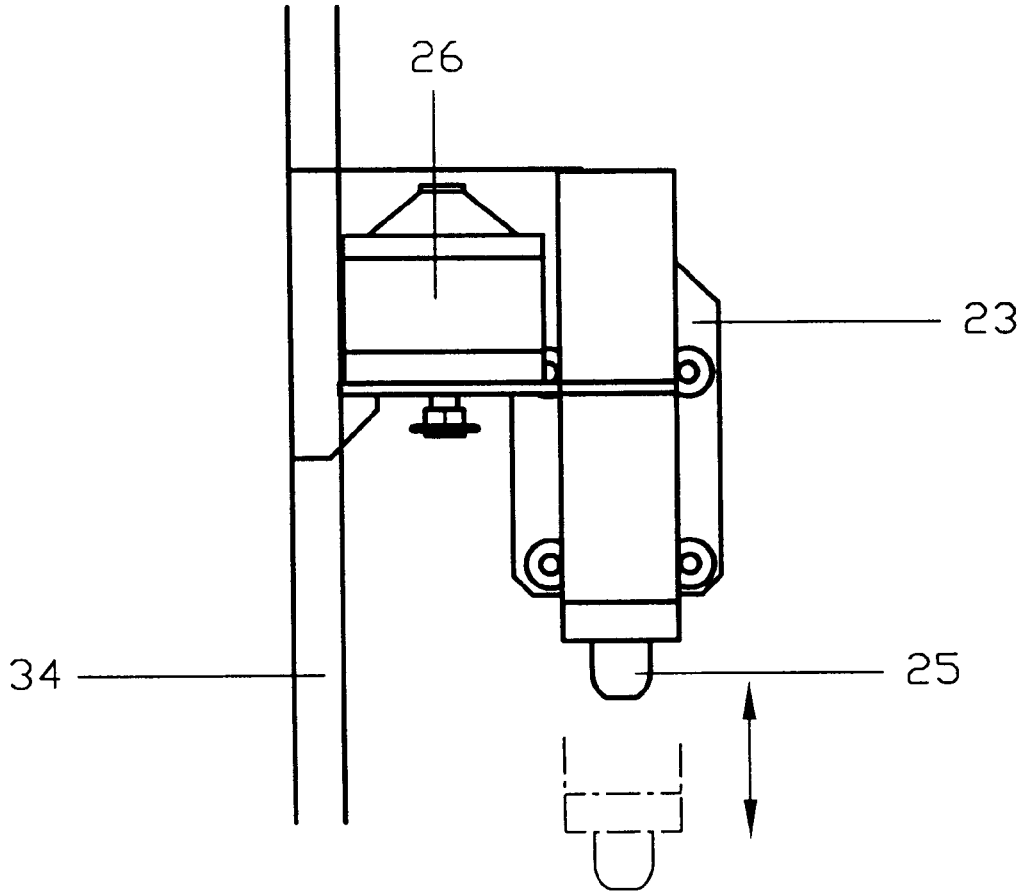
FIG. 9 is a side view of the indexing system in axial section.
Figure 10:
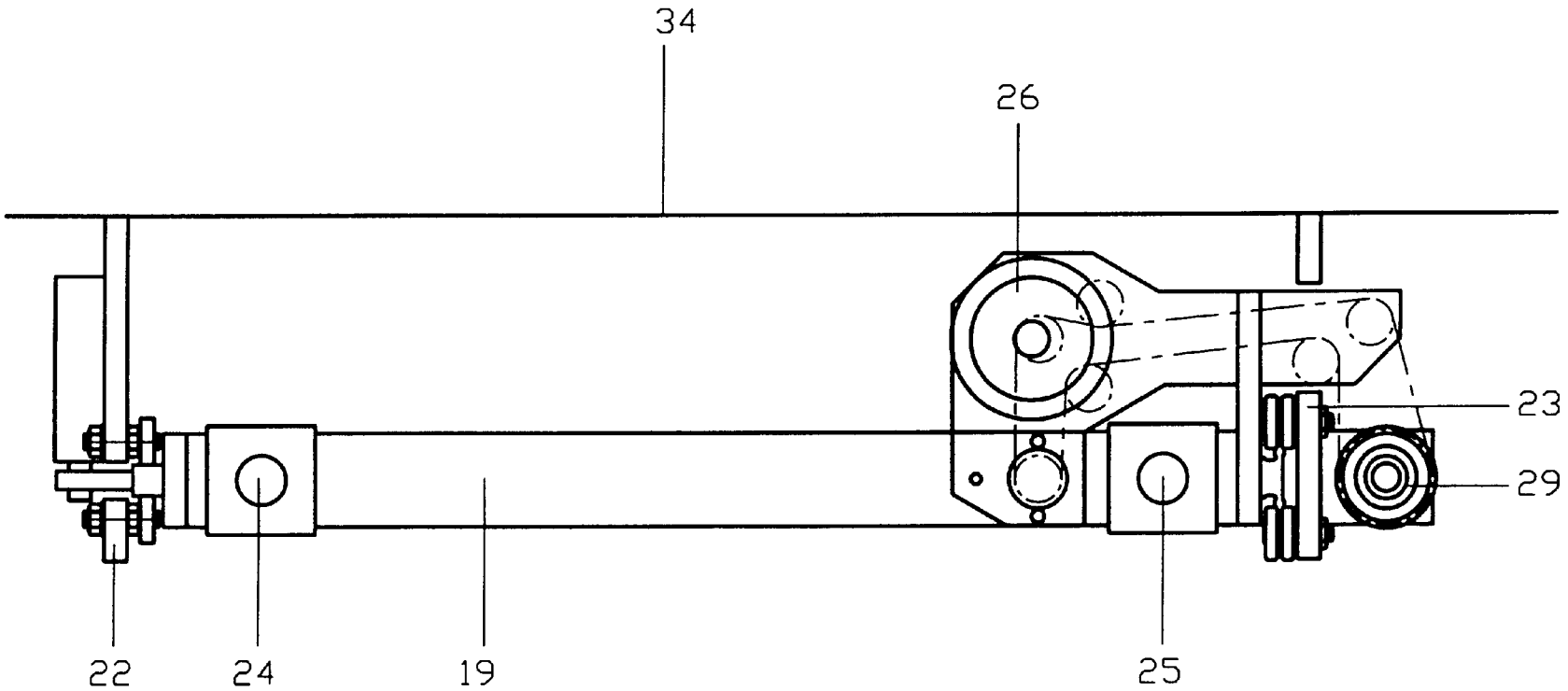
FIG. 10 is a top view of the indexing system.

In FIG. 9, dot and dash lines moreover represent the index 25 in its lowered position which makes it possible to lock the container.

Figure 11:
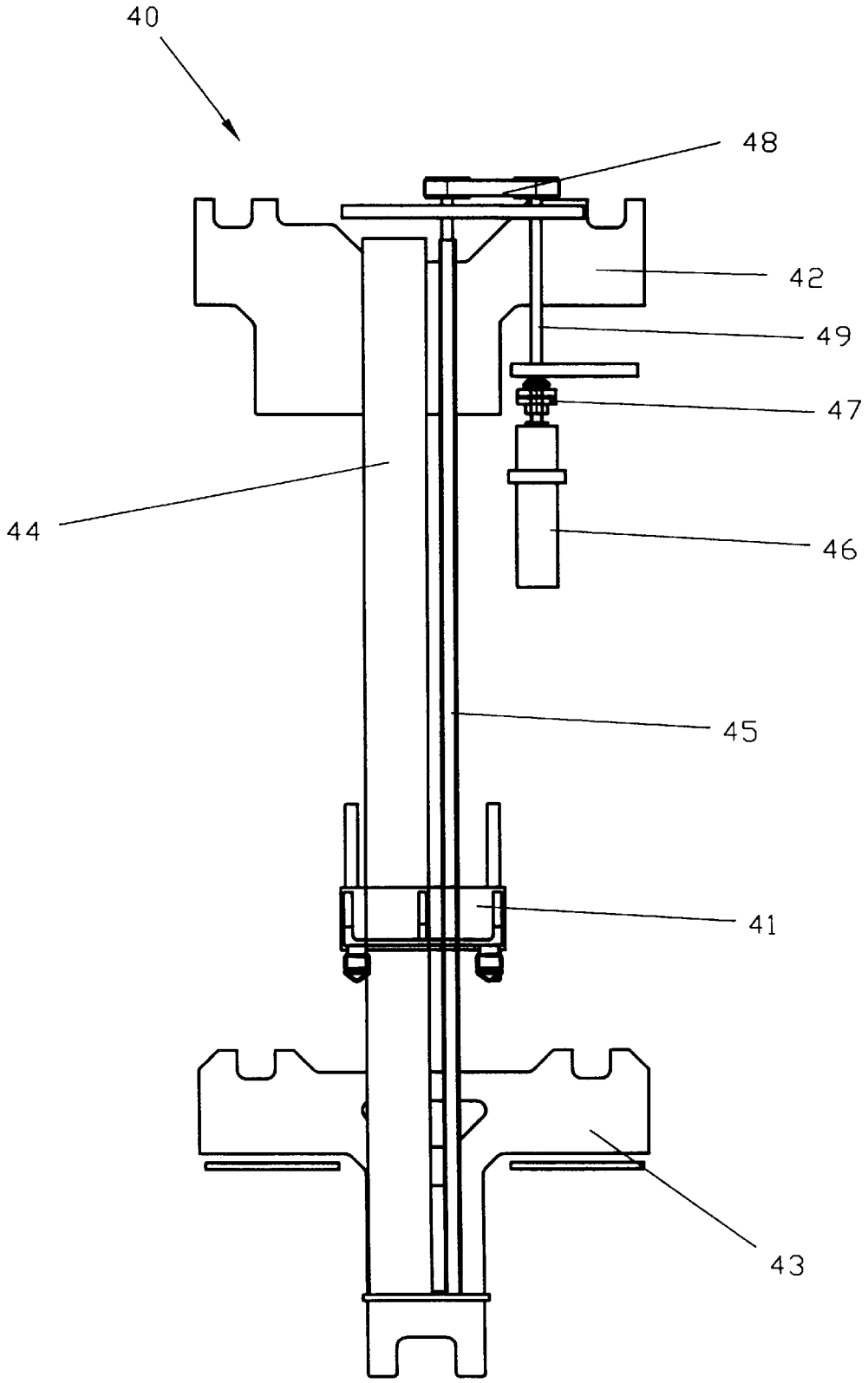
FIG. 11 is a top view of the transfer system, partially in horizontal section.

The transfer system is now described with reference to FIGS. 11, 12 and 13. This transfer system 40 comprises a pusher 41 in the form of a vertical post, two horizontal frames 42 and 43 connected to one another by means of a guide rail 44, to which the pusher 41 is fastened and on which it moves. In order to drive the pusher 41 along the guide rail 44, the system comprises, furthermore, a ball screw 45 arranged parallel to the guide rail 44. The ball screw 45 itself is connected, at one of its ends, to a serrated transmission 48 connected to a motor 46 by means of a transmission shaft 49 and of a safety torque limiter 47. The transfer system 40 as a whole is mounted inside each tray rack of a machine for the production of securities and, when the rack is to be emptied into a container previously indexed and locked, as described above, a suitable control starts the motor 46 which, by driving the ball screw 45 by means of the transmission, causes the pusher 41 to move along the guide rail 44. This movement of the pusher 41 transfers all the trays of the tray rack 31 into the container 1 in a single pass. Once the trays have been transferred, the rotation of the motor 46 is reversed and the pusher 41 returns rearward along the rail 44.

Figure 12:
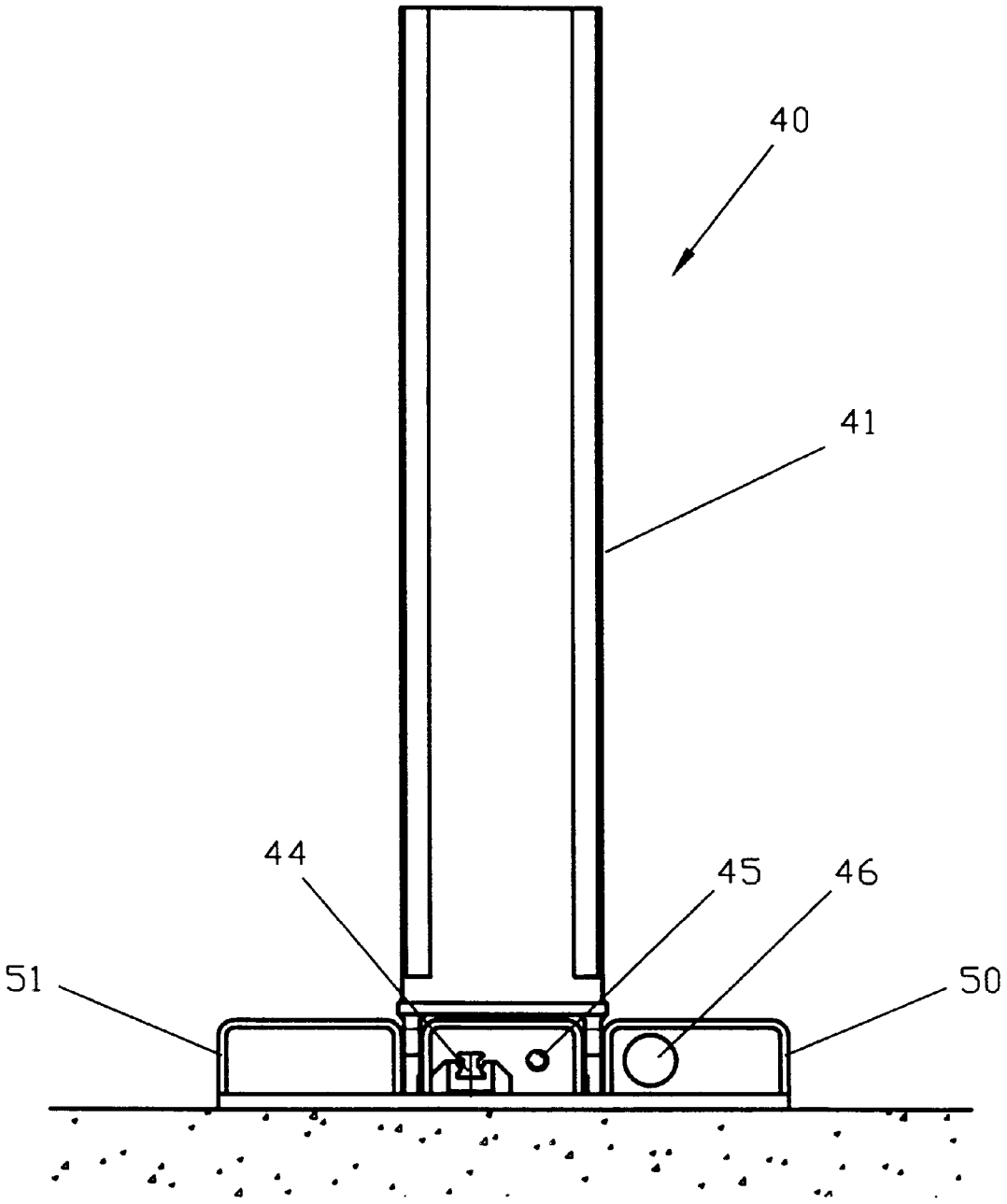
FIG. 12 is a sectional front view of the transfer system.
Figure 13:
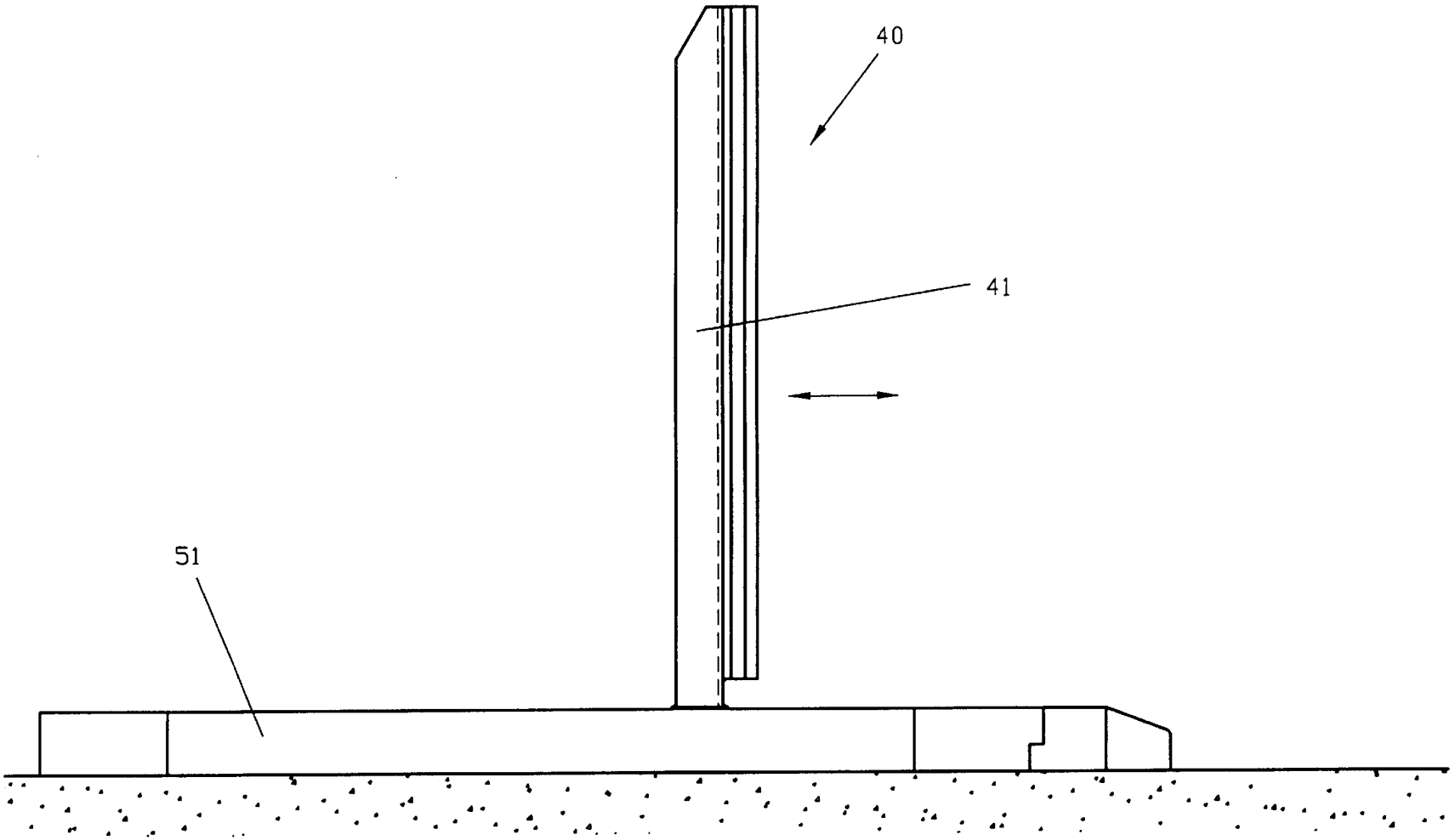
FIG. 13 is a side view of the transfer system.

In FIG. 12, two protective plates 50, 51 are also illustrated, the plate 51 making it possible to protect the motor 46 for driving the pusher 41.

In order to make it possible to automate the method, a control and checking unit is used, as well as checking means, control means and transmission means. The control and checking unit makes it possible to determine the commands to be executed, for example the lowering of the indexing and interlocking system, the opening of the door, the moving of the pusher, the closing of the door or the release of the container. This unit may be a computer. The checking means make it possible to check that a command can be executed or has been executed. These means comprise, for example, position sensors associated with the movable elements of the apparatus. The transmission means, such as cables and pneumatic circuits, make it possible to transmit the commands from the control and checking unit to the actuators and to receive the information coming from the checking means.

One of the advantages of the apparatus according to the invention is that it is completely modular. In fact, the indexing system may readily be placed on an existing machine for the production of securities, since it is sufficient to mount said system on top of the tray rack and connect the pneumatic elements to the compressed air network already present on these production machines. On the other hand, the transfer system may be integrated into the tray racks of existing production machines.

The embodiments are given by way of example and variations are possible within the scope of the claimed invention. For example, the racks of the production machine may also be equipped with a sliding door. The latter then can be opened only when a container has been indexed and interlocked, and it will be closed after the door of the container. This design makes it possible to produce a kind of lock chamber for the printed sheets, to which there will be no free access at any moment. Moreover, the door of the container may be wound vertically on one side of the container, instead of horizontally at the top of the container. The container may also comprise a second door similar to the first and placed on the wall facing the latter. This embodiment would make it possible to reduce the handling of the container when it is being unloaded.

We claim:

1. A method for unloading elements from an exit of a machine for the production of such elements comprising at least one tray rack supporting trays carrying said elements and having an exit, said method comprising the following steps:

a) placing of a container comprising at least one door said door being placed adjacent to the exit of the tray rack, b) positioning and locking of the container relative to the rack wherein this step comprises:

positioning of the container by centering means for aligning the container with the tray rack, locking of the container through an index system, wherein the step of locking the container comprises the following actions:

coupling of a door opening and closing driver, detection of the position of the door, control of a motor connected to the door opening and closing driver, in order to open the door, if the door is detected as being closed, the coupling of the door opening driver taking place at the same time as the locking of the container by means of the index system;

c) transfer of the trays together from the rack into the container, wherein said elements carried by the trays comprise reams of sheets of securities, d) closing of the door of the container, and e) unlocking of the container, the latter then being capable of being moved.

2. The method as claimed in claim 1, wherein the transfer of the trays carrying the reams from the rack into the container takes place simultaneously for all the trays, and wherein a pusher is used for carrying out the transfer step.

3. The method as claimed in claim 1, wherein the step of closing the door of the container comprises the following actions:

control of the motor connected to the door opening and closing driver in order to close the door, withdrawal of the door opening and closing driver, and latching of the door to prevent access to the reams of sheets.

4. The method as claimed in claim 1, wherein the step of unlocking the container comprises the withdrawal of the index system.

* * * * *